US005550424A

United States Patent [19]

Jennrich et al.

[11] Patent Number: 5,550,424

[45] Date of Patent: Aug. 27, 1996

[54] SPARK PLUG FOR INTERNAL COMBUSTION ENGINES

[75] Inventors: Irene Jennrich, Winnenden; Lothar Weber, Stuttgart; Andreas Niegel, Kornwestheim, all of Germany

[73] Assignee: Robert Bosch GmbH, Stuttgart, Germany

[21] Appl. No.: 448,424

[22] PCT Filed: Nov. 27, 1993

[86] PCT No.: PCT/DE93/01133

§ 371 Date: Jun. 5, 1995

§ 102(e) Date: Jun. 5, 1995

[87] PCT Pub. No.: WO94/13046

PCT Pub. Date: Jun. 9, 1994

[30] Foreign Application Priority Data

Dec. 3, 1992 [DE] Germany ..... 42 40 646.3

[51] Int. Cl.[6] ..... H01J 13/38

[52] U.S. Cl. ..... 313/130; 313/131 R; 313/137

[58] Field of Search ..... 313/130, 131 R, 313/137, 131 A, 143; 123/169 P, 169 EL

[56] References Cited

U.S. PATENT DOCUMENTS

| | | | |
|---|---|---|---|
| 3,345,532 | 10/1967 | Mattarella | 313/131 RX |
| 4,415,828 | 11/1983 | Mizuno et al. | 313/143 X |
| 4,427,914 | 1/1984 | Mizuno et al. | 313/130 |
| 4,798,991 | 1/1989 | Benedikl et al. | 313/137 |
| 5,274,298 | 12/1993 | Cassidy et al. | 313/137 X |

FOREIGN PATENT DOCUMENTS

| | | | |
|---|---|---|---|
| 3129025 | 3/1982 | Germany . | |
| 0057038 | 5/1979 | Japan | 313/137 |
| 1-231281 | 9/1989 | Japan . | |
| 1005107 | 9/1965 | United Kingdom . | |

*Primary Examiner*—Sandra L. O'Shea
*Assistant Examiner*—Ashok Patel
*Attorney, Agent, or Firm*—Kenyon & Kenyon

[57] ABSTRACT

A spark plug for igniting fuel/air mixtures in internal combustion engines, in particular in internal combustion engines of motor vehicles. On its insulating-body foot, the spark plug has a coating which is intended to protect against misfirings and cold-starting difficulties as a consequence of electrically conductive deposits, in particular in the case of installation of spark plugs in new motor vehicles. The coating includes solvent-free silicone rubber or silicone resin. The silicone rubber may contain filler and is provided with silicone oil for the purpose of good processability. Expediently, the inner side of the metal housing which is exposed to the combustion chamber is also covered with the coating. The coating is physiologically safe, environmentally acceptable and resistant to handling, and does not require expensive extraction systems if it is sprayed onto the appropriate region of the spark plug by means of nozzles.

7 Claims, 1 Drawing Sheet

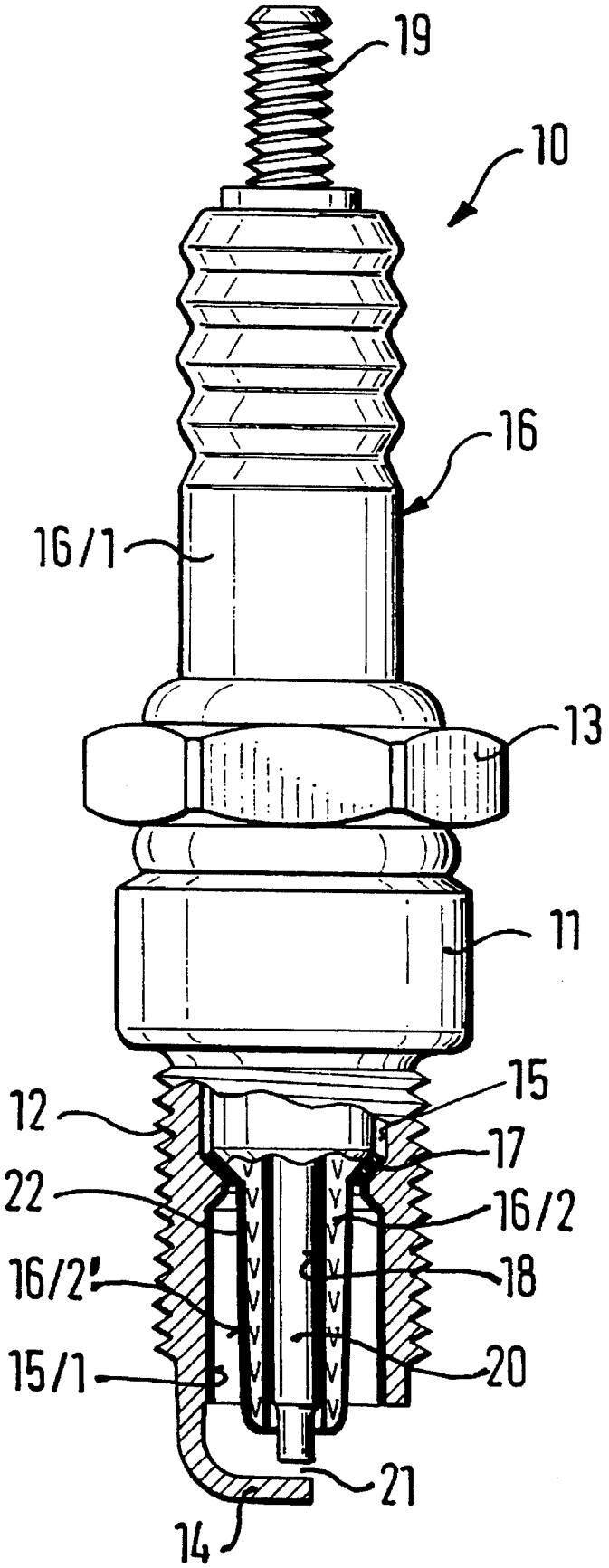
19
10
16
16/1
13
11
15
12
17
22
16/2
16/2'
18
15/1
20
21
14

SPARK PLUG FOR INTERNAL COMBUSTION ENGINES

FIELD OF THE INVENTION

The present invention relates to a spark plug for an internal combustion engine. In particular, the present invention relates to a spark plug having a coating to protect against misfirings and cold-starting difficulties.

A spark plug has already been disclosed (German Patent No. DE 31 29 025 C2), in which the longitudinal portion (foot) of the insulating body on the combustion-chamber side is provided with a coating which is intended to prevent electrically conductive deposits and is composed of a paraffin solution containing at least 0.1% silicone oil. According to the Patent Specification, the inner side of the spark-plug metal housing which is adjacent to the insulating-body foot may also be coated with such a coating. To produce the coating, the paraffin and the silicone have to be dissolved in a solvent such as trichloroethylene, chlorobenzene, toluene or the like, whose use is undesirable from physiological points of view and for environmental reasons.

The coating on the insulating-body foot is intended to avoid electrically conductive deposits which form during the operation of internal combustion engines at temperatures of the insulating-body foot below 500° C. These deposits are carbon, water and other electrically conductive substances originating from the fuel. As a consequence of these deposits, energy originating from the ignition system may leak away in an undesirable manner in the form of creepage currents even before the actual ignition time of the internal combustion engine and result in cold-starting problems and misfirings in the internal combustion engine. With their consequences described above, the deposits have a particularly troublesome effect in the case of the installation of spark plugs in new motor vehicles, which often travel only with low speeds and/or low load during their running-in phase of a few hundred km and consequently do not raise the temperature of the insulating-body foot of the spark plugs above the so-called free-burn temperature of 500° C.

Silicone oil was also already proposed for such coatings, but it did not prove to be sufficiently effective and resulted, specifically as a consequence of the penetration of carbon and/or water into the silicone oil layer, in undesirable electrical conductivity of the insulating-body foot.

SUMMARY OF THE INVENTION

The spark plug according to the present invention has, on the other hand, the advantage that the substance used as protection against contamination of the insulating body foot is not only sufficiently effective but is at the same time solvent-free, that is to say physiologically safe and environmentally acceptable. Expensive extraction systems are therefore unnecessary for the application of such coatings. To be regarded as a further advantage is the fact that the coating according to the present invention is resistant to handling and does not lose its protection against contamination even during prolonged storage of such spark plugs.

Advantageous further developments and improvements of the spark plug according to the present invention include that it is particularly advantageous if that inner side of the metal housing which is adjacent to the insulating-body foot is also covered with such a coating. As a consequence of this measure, the undesirable leakage of energy is prevented still further and, in addition, the application of the coating is also generally simplified.

BRIEF DESCRIPTION OF THE DRAWING

The FIGURE shows an enlarged representation of a spark plug in longitudinal view with a section through its end portion on the combustion-chamber side.

DETAILED DESCRIPTION OF THE INVENTION

The (high-voltage) spark plug 10 shown in the FIGURE of the drawing has an essentially tubular metal housing 11 which has, on its outer side, a screw insertion thread 12 and a hexagonal nut head 13 as means for the installation of the spark plug 10 in an internal combustion engine, which is not shown, in particular in an internal combustion engine of motor vehicles. In the region of its end at the combustion-chamber the said metal housing 11 has a counterelectrode 14, which is of hook-shaped design. The representation of a sealing ring or a sealing surface on the connecting side of the screw insertion thread 12 was omitted. In its axial bore 15, the metal housing 11 encompasses, in a known manner, a ceramic, rotationally symmetrical insulating body 16. The insulating body 16 is generally composed essentially of sintered aluminum oxide and has, on the connecting side, a so-called head 16/1 which projects out of the metal housing 11 and which is adjoined inside the metal housing 11 by a collar (which is not shown) and furthermore by an insulating-body foot 16/2 still essentially encompassed by the metal housing 11. In the region mentioned, the insulating body 16 is held firmly and in a sealing manner by the metal housing 11, inter alia, by means of a sealing ring 17 which is disposed between the end of the insulating-body foot 16/2, which end extends in the form of a truncated cone on the connecting side, and an annular shoulder (without reference symbol) situated in the axial bore 15 of the metal housing 11.

The insulating body 16 has, in a known manner, a longitudinal bore 18, out of which a connecting element 19 projects on the connecting side, which element is designed in the present example as a threaded portion. The connecting element 19 serves to connect the spark plug 10 to a known ignition system, which is not shown. Mounted in a sealed manner in the longitudinal bore 18 of the insulating body 16 is, in addition, an essentially cylindrical central electrode 20, which is electrically connected to the connecting element 19 and is composed of a fireproof material, for example a nickel alloy. The air spark gap formed between the end portion of the central electrode 20 on the combustion-chamber side and the counterelectrode 14 is denoted by 21.

The region of the spark plug 10 which is directly accessible to the combustion chamber of the internal combustion engine (not shown) comprises the insulating-body foot 16/2, in particular its outer side 16/2', and the inner side 15/1 of the metal housing axial bore 15 which is adjacent to the outer side 16/2' of the insulating-body foot 16/2. On the connecting side, the region is bounded by the sealing ring 17 between insulating body 16 and metal housing 11.

Accessible to the combustion chamber of the internal combustion engine to a limited extent, however, is also the narrow annular gap (without reference symbol) which is formed between the central electrode 20 and the insulating-body longitudinal bore 18 and which is sealed on the connecting side by a sealing compound, which is not shown and which is preferably of an electrically conductive glass.

At least the outer side 16/2' of the insulating body foot 16/2 which extends up to the sealing ring and preferably, however, also the inner side 15/1 of the metal housing-11 which has been described, are coated with a coating 22, which avoids electrically conductive deposits which form during the operation of internal combustion engines at temperatures of the insulating-body foot 16/2 below 500° C. These deposits may be carbon, water and other electrically conductive substances originating from the fuel. As a consequence of such deposits, energy originating from the ignition system would leak away in an undesirable manner in the form of creepage currents from the central electrode 20 to the metal housing 11, which is generally electrically at ground, via the deposits on the outer side 16/2' of the insulating-body foot 16/2 even before the actual ignition time of the internal combustion engine. With their consequences described above, the deposits have a particularly troublesome effect in the case of the installation of spark plugs in new motor vehicles, which often travel only with low speeds and/or low load during their running-in phase of a few hundred km and consequently do not raise the temperature of the insulating-body foot 16/2 of the spark plugs above the so-called free-burn temperature of 500° C. Under these circumstances, the electrically conductive deposits reveal themselves because of their undesirable effects, particularly during cold starting of such internal combustion engines.

The coating 22 according to the present invention is composed of, for example, solvent-free silicone rubber or solvent-free silicone resin. The solvent-free silicone rubber may also, at the same time, be provided with a proportion of filler (for example, highly dispersed silicic acid). For the purpose of good processability, the coating 22 composed of silicone rubber may be mixed with silicone oil, and the proportion of silicone oil may amount to up to 99.9%, but is preferably between 75 and 85%. The silicone may be of types which crosslink as a result of moisture or cure as a consequence of the effect of light or heat. In this connection, the silicone may also be used as a lacquer, but the lacquer should not be mixed with substances which deposit carbon in the event of a thermolysis.

The coating 22 is preferably introduced via nozzles into the region (16/2' and 15/1) on the combustion-chamber side which is accessible to the combustion chamber of the internal combustion engine, and this material may also penetrate into the annular gap situated between central electrode 20 and insulating-body longitudinal bore 18. Since the substance used for the coating 22 is physiologically safe and environmentally acceptable, expensive extraction systems are not necessary in the execution of this method. The application of such coatings 22 to the portion 16/2 of the insulating body 16 which is on the combustion-chamber side, i.e. both on its outer side 16/2' and on the corresponding region of the insulating-body longitudinal bore 18, can also be carried out at a suitable point during the assembly process of such spark plugs 10 by immersion processes, brushing processes, printing processes and, of course, also by spraying.

The coating 22 according to the present invention can also be used in spark plugs in which the counterelectrode 14 is disposed in another known way and in which the spark gap 21 is not a pure air spark gap but also a combined air-creepage spark gap or even a pure creepage spark gap.

We claim:

1. A spark plug for an internal combustion engine, comprising:

a tubular metal housing having an axial bore disposed therethrough and a counterelectrode formed at one end of the housing, the housing having an outer surface adapted for removably mounting the housing in the internal combustion engine;

a ceramic insulating body having a longitudinal opening disposed therethrough, at least one longitudinal portion of the ceramic insulating body being sealably disposed within the axial bore of the tubular metal housing;

a connecting element mounted in a first portion of the longitudinal opening;

a central electrode sealably mounted in a second portion of the longitudinal opening, the central electrode being electrically connected to the connecting element, an end region of the central electrode being opposed to an end region of the counterelectrode, a spark gap being formed between the central electrode and the counterelectrode; and wherein a lower portion of the ceramic insulating body is exposed to a combustion chamber of the internal combustion engine, at least one surface of the lower portion having a silicone coating to protect against contamination, the coating being composed of one of a solvent-free silicone rubber and a solvent-free silicone resin.

2. The spark plug according to claim 1, wherein the coating composed of the solvent-free silicone rubber includes a predetermined amount of a filler.

3. The spark plug according to claim 2, wherein the filler includes highly dispersed silicic acid.

4. The spark plug according to claim 1, wherein the coating composed of the solvent-free silicone rubber includes silicone oil.

5. The spark plug according to claim 4, wherein the coating includes a maximum of 99.9% silicone oil.

6. The spark plug according to claim 4, wherein the coating includes silicone oil in a range of 75% to 85%.

7. The spark plug according to claim 3, wherein the coating is further applied to an inner surface of the tubular metal housing, the inner surface being adjacent to the lower portion of the insulating body.

* * * * *

UNITED STATES PATENT AND TRADEMARK OFFICE

CERTIFICATE OF CORRECTION

PATENT NO. : 5,550,424

DATED : August 27, 1996

INVENTOR(S) : Jennrich et al.

It is certified that error appears in the above-identified patent and that said Letters Patent is hereby corrected as shown below:

Col. 1, between lines 10 and 11, insert --BACKGROUND INFORMATION --.

Col. 2, line 7, after "plug" insert -- according to the present invention --.

Col. 2, line 20, delete "said".

Col 4, line 49, change "claim 3," to -- claim 1, --.

Signed and Sealed this

Second Day of March, 1999

*Attest:*

*Attesting Officer*

Q. TODD DICKINSON

*Acting Commissioner of Patents and Trademarks*